US007232082B2

(12) United States Patent
Mühlhausen et al.

(10) Patent No.: US 7,232,082 B2
(45) Date of Patent: Jun. 19, 2007

(54) DISPENSER BOTTLE FOR AT LEAST TWO ACTIVE FLUIDS

(75) Inventors: Hans Georg Mühlhausen, Düsseldorf (DE); Rainer Geberzahn, Jüchen (DE); Paul-Otto Weltgen, Hilden (DE)

(73) Assignee: Henkel Kommanditgesellschaft auf Aktien, Dusseldorf (DE)

( * ) Notice: Subject to any disclaimer, the term of this patent is extended or adjusted under 35 U.S.C. 154(b) by 0 days.

(21) Appl. No.: 11/501,645

(22) Filed: Aug. 9, 2006

(65) Prior Publication Data

US 2007/0012806 A1 Jan. 18, 2007

Related U.S. Application Data

(63) Continuation of application No. PCT/EP2005/001280, filed on Feb. 9, 2005.

(30) Foreign Application Priority Data

Feb. 13, 2004 (DE) ..... 10 2004 007 505

(51) Int. Cl.
*B05B 1/04* (2006.01)

(52) U.S. Cl. ..... 239/593; 239/521; 239/463; 239/418; 239/304; 222/547; 222/564; 222/137

(58) Field of Classification Search ..... 239/399, 239/414, 418, 450, 461, 463, 504, 518, 521, 239/523; 222/547, 564, 592, 137
See application file for complete search history.

(56) References Cited

U.S. PATENT DOCUMENTS

| | | | | |
|---|---|---|---|---|
| 4,121,739 | A * | 10/1978 | Devaney et al. | 222/137 |
| 5,102,016 | A * | 4/1992 | Ball et al. | 222/145.3 |
| 5,228,599 | A * | 7/1993 | Keller | 222/137 |
| 5,501,371 | A * | 3/1996 | Schwartz-Feldman | 222/136 |
| 5,911,909 | A | 6/1999 | Coyle-Rees | |
| 5,972,239 | A | 10/1999 | Coyle-Rees | |
| 6,065,643 | A * | 5/2000 | Harvey et al. | 222/94 |

FOREIGN PATENT DOCUMENTS

| | | |
|---|---|---|
| DE | 102 38 431 A1 | 3/2004 |
| WO | WO 91/04923 | 4/1991 |
| WO | WO 2004/018319 A1 | 3/2004 |

* cited by examiner

*Primary Examiner*—Dinh Q. Nguyen
(74) *Attorney, Agent, or Firm*—Paul & Paul

(57) ABSTRACT

A dispenser bottle comprising two receptacles for two (preferably different) fluid active substances wherein both receptacles have outlets arranged next to one another in such a way that both active fluids can be applied to a common application field. The receptacles are compressible and provided with discharge nozzles so that the active fluids are mixed with one another only after exiting from the discharge nozzles. The nozzle channels of the discharge nozzles taper towards each other and are preferably substantially parallel. The nozzle channels have an annular construction below the outlet on the inner periphery and have edged transitions with a chamfer forming a bevel on the influx side.

11 Claims, 9 Drawing Sheets

STATE OF THE ART

STATE OF THE ART

STATE OF THE ART

STATE OF THE ART

STATE OF THE ART

STATE OF THE ART

STATE OF THE ART

STATE OF THE ART

STATE OF THE ART

STATE OF THE ART

STATE OF THE ART

STATE OF THE ART

DISPENSER BOTTLE FOR AT LEAST TWO ACTIVE FLUIDS

CROSS REFERENCE TO RELATED APPLICATIONS

This application is a §365 (c) continuation application of PCT/EP2005/001280 filed Feb. 9, 2005, which in turn claims priority to DE Application 10 2004 007 505.0 filed Feb. 13, 2004, each of the foregoing applications is incorporated herein by reference.

FIELD OF THE INVENTION

The invention relates to a dispenser bottle for at least two active fluids, which causes the active fluids to be mixed together only after being dispensed from the container.

BACKGROUND OF THE INVENTION

The starting point for the teaching of the present patent application is a dispenser bottle for at least two active fluids, preferably for exactly two active fluids, which is known from an older, but not prior-published, application of the same applicant (DE 102 38 431 A1 and WO 2004/018319 A1). The disclosure of the application documents of DE 102 38 431 A1 and WO 2004/018319 A1 is hereby incorporated by reference into the disclosure of the present patent application.

The previously discussed state of the art, which is not prior-published relative to the priority date of the present patent application, relates to a dispenser bottle with a first receiving container for a first active fluid and at least one, preferably exactly one, second receiving container for a second active fluid, wherein the two receiving containers are either separately constructed and connected together or constructed integrally with one another and wherein the receiving containers each have an outlet for the active fluid and the outlets are so arranged adjacent to one another that the two active fluids can be applied in a common application field of an application region.

This state of the art assumes that the use of active fluids which shall be or have to be stored separately from one another is known from some fields of use, particularly from the field of cleaning surfaces. These active fluids are to come together only shortly prior to or during application to the application region, for example a floor, the surface of a toilet bowl, etc. Examples thereof are bleaching, cleaning, decalcifying and disinfecting agents containing chlorine (for example, WO 98/21308 A2). Active fluids of conventional kind are also applied to, for example, surfaces in bathrooms or in other hygienically sensitive areas.

Active fluids are stored in different receiving containers particularly when they do not have storage stability together. However, other reasons for separate storage of active fluids to be applied together are also known, for example different colorations to communicate different functions of the active fluids, different light sensitivities, etc.

The dispenser bottle—from which the afore-mentioned state of the art (WO 98/21308 A2 and U.S. Pat. No. 5,398,846 A) proceeds—for at least two different active fluids which do not have storage stability together comprises a bottle which has two mutually separate chambers forming the receiving containers and which is provided at the upper end with directly adjacent outlets for the active fluids in the two receiving containers. A first aqueous solution is in one receiving container and a second aqueous solution in the second receiving container. The concentration of the components in the two aqueous solutions is in that case selected so that when a specific quantity of the first aqueous solution is mixed with a specific quantity of the second aqueous solution the acidic bleaching solution, which is desired in this prior art, is the result.

The dispenser bottle of the previously explained, prior-published state of the art comprises a pumping device able to be placed on the outlets of the two receiving containers of the dispenser bottle. The active fluids are brought together in the pumping device and expelled in a common spray jet from a discharge nozzle. The active fluids are thus intermixed before they leave the discharge nozzle.

A similar dispenser bottle in which cross-contamination between the two receiving containers can be avoided with a substantial degree of certainty is similarly known (WO 91/04923 A1; DE 690 16 44 T2). In this dispenser bottle a pumping spray device is not provided, but the outlets are simply open and provided with spouts and can be reclosed by means of a closure cap. However, this dispenser bottle is not suitable for spray application.

A dispenser bottle for an active fluid with a receiving container of flexible plastics material and a discharge nozzle specifically for cleaning WC bowls is known (EP 0 911 616 B1), wherein for optimal application of the active fluid in toilet bowls, particularly below the inner edge thereof, the outlet nozzle is formed as a bent-over dosing pipe.

The teaching of the state of the art forming the starting point of the invention has the object of indicating a dispenser bottle with at least two receiving containers for two active fluids, which can be produced economically and is simple for a user to handle and in that case allows two active fluids to be applied separately from one another, but to come together in an application field.

The previously outlined object is fulfilled in the case of the dispenser bottle of the state of the art forming the starting point of the invention in that the receiving containers are constructed as compressible containers and the outlets are each provided with at least one, preferably with exactly one, discharge nozzle so that the active fluids are intermixed only after leaving the discharge nozzles.

The receiving containers according to the teaching of the state of the art forming the starting point of the invention are constructed as compressible containers. Through compression of the receiving containers by the hand of a user there is thus generated in the receiving containers the necessary internal pressure for discharge of the active fluids from the respective, separately provided discharge nozzles. The active fluids thus first mix in the application field only after leaving the discharge nozzles. The desired product to be applied, thus in particular the cleaning agent, bleaching agent, etc., which develops the desired action in the application field, thereby results from the two active fluids during the application.

The dispenser bottle according to the teaching of the state of the art forming the starting point of the invention achieves the previously explained result by a solution which is constructionally very simple and easy to handle, particularly through elimination of a pumping spray device. This dispenser bottle is thus very suitable for use as a mass-production product, particularly for cleaning agents of all kind, especially also for toilet cleaning. However, these dispenser bottles can also be used for a number of other cases of use, for example for dosing textile cleaning agents (washing agent in washing machines, etc.), textile pretreatment agents (bleaching agents etc.) and textile post-treatment agents (softeners, etc.), for dosing of hand and machine dishwashing agents and dishwashing additives (clear rinsing agents, decalcifying agents, etc.) and finally also for dosing surface cleaning agents and surface treatment agents of all kinds.

By active fluids in the sense of the teaching of the state of the art forming the starting point of the invention there are to be understood all liquid and other flowable media, from low-viscosity to high-viscosity through gel-like to pasty substances. In that case, on the one hand the viscosity of the active fluids is of significance for the respective application of interest and on the other hand and in particular degree the thixotropy of the active fluids is also of significance (for explanation of the concept of thixotropy, i.e. the phenomenon that specific active fluids liquefy under the action of mechanical forces, but after the end of the mechanical loading, in a given case with a considerable delay in time, solidify again, thus have a viscosity dependent on the action of mechanical forces, see RÖMPP LEXIKON Chemie, 10th Edition, Georg Thieme Verlag, Stuttgart, 1999, Vol. 6, page 4533).

The present invention embodies preferred features and developments of state-of-the art containers forming the starting point of the invention.

Special and independent significance attaches to an embodiment of the state-of-the-art containers which form the starting point of the invention, in which the design and dimensions of the discharge nozzles and the characteristics, particularly the viscosities and/or the thixotropy, of the active fluids are so matched to one another that—in the case of average pressure by the hand of a user—the fluid flows come into coincidence at a defined, precalculated distance. This means that through appropriate design of the discharge nozzles the flows of active fluids issuing from the discharge nozzles flow onto one another to a certain extent curvilinearly and collide at a spacing from the discharge nozzles which varies somewhat depending on the outflow pressure. The application field of the application region can be located here. This design with the cross-sectional constrictions has particular significance especially when the active fluids are active fluids with substantially identical thixotropy.

In the interim there has also appeared a publication concerning a dispenser bottle with receiving containers for two active fluids (U.S. Pat. No. 6,583,103 B1), which as prior-published state of the art has at any rate all features of the dispenser bottle of claim 1 of DE 102 38 431 A1. Cross-sectional constrictions in the nozzle channels of the outlet nozzles are not provided here.

Also published in the interim was a further publication (WO 2004/045968 A1) which will in a given case illustrate older, not prior-published state of the art if a corresponding validation should take place. This, too, shows a dispenser bottle according to category with receiving containers for two active fluids.

The state of the art which is not prior-published and forms the starting point of the present invention is concerned with various proposals how cross-sectional constrictions can be arranged and formed in the nozzle channels of the discharge nozzles so as to achieve the desired effect of the fluid flows coming into coincidence at a defined, precalculated spacing from the discharge nozzles.

SUMMARY OF THE INVENTION

The present invention has the object in that respect making a further proposal for an arrangement and construction of the cross-sectional constrictions in the nozzle channels of the discharge nozzles.

According to the teaching of the present invention the above-explained object is fulfilled, in the case of a dispenser bottle by providing constrictions with are chamfered to provide bevels in the nozzle channels of the active fluids.

Particularly preferred embodiments and developments of the invention are set forth more fully hereinafter.

The arrangement and construction of the cross-sectional constrictions in the nozzle channels in accordance with the teaching of the present invention can be realised particularly simply in terms of production engineering. Moreover, it is possible to modify the point of convergence of the fluid flows in dependence on the respective field of use of the dispenser bottle in that the bevel angle of the bevels is simply appropriately modified in the production tool.

This is independent of the fact that the other dimensions of the nozzle channels of the discharge nozzles can be modified in accordance with the respective viscosities and desired metering quantities, as already described in DE 102 38 431 A1 and WO 2004/018319 A1.

Preferred embodiments incorporate all patent claims of DE 102 38 431 A1 and WO 2004/018319 A1 in the present invention.

BRIEF DESCRIPTION OF THE DRAWINGS

The disclosure of the state of the art forming the starting point for the present invention and subsequently an example of embodiment of the teaching of the present invention are now explained in more detail in the following by reference to the drawings, in which.

DESCRIPTION OF PREFERRED EMBODIMENTS OF THE INVENTION

Figure 1:
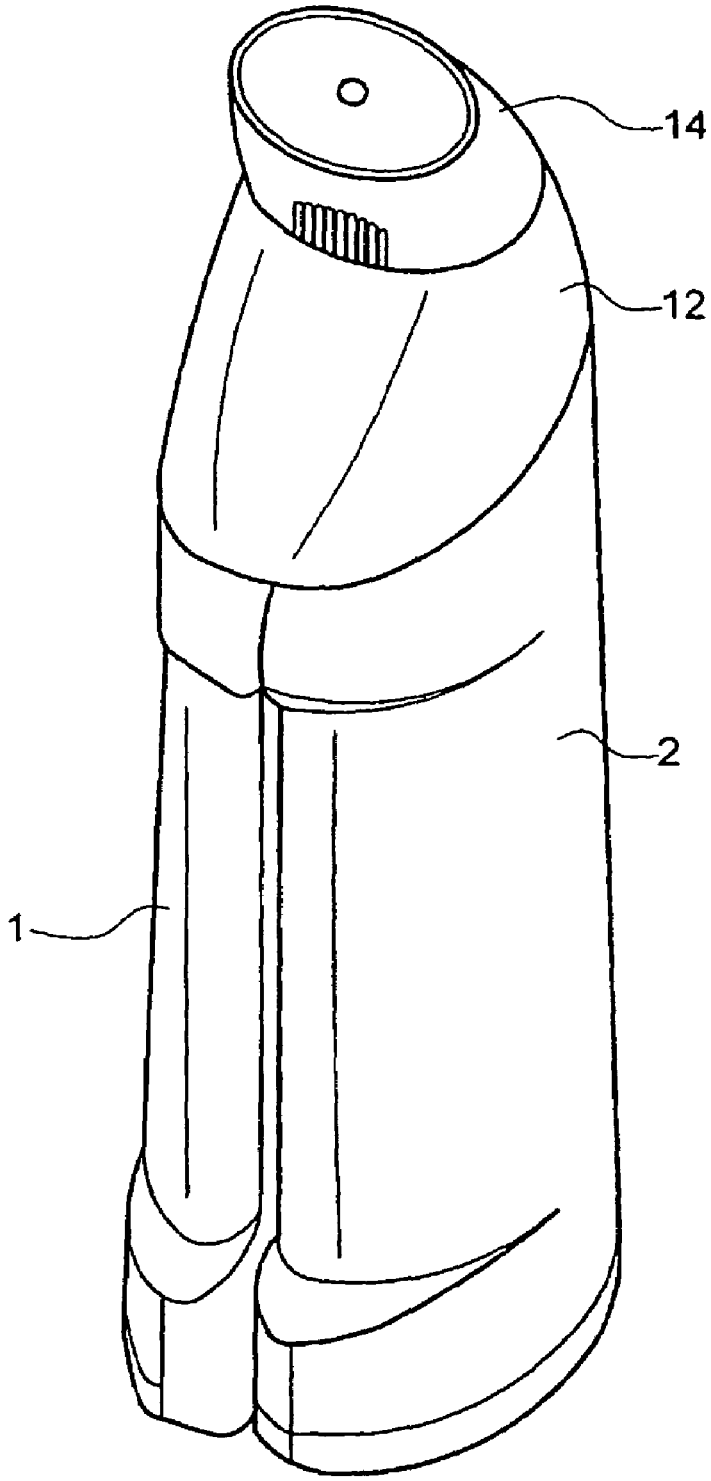
FIG. 1 is a front perspective view showing an example of embodiment of a dispenser bottle according to the teaching of the state of the art forming the starting point of the present invention.

The subject of the state of the art forming the starting point of the present invention is a dispenser bottle as illustrated in FIG. 1. There can be seen on the left a first receiving container 1 for a first active fluid and on the right a second receiving container 2 for a second active fluid. In principle also more than two receiving containers 1, 2 can be provided, for example three receiving containers for three active fluids or even four receiving containers for four active fluids which are to come into coincidence in the application region.

The active fluids are frequently active fluids which do not have storage stability together; however, that is not an essential precondition. Reference may be made to the explanations given beforehand. Equally, reference may be made to the foregoing explanations with respect to the definition of the notion of an active fluid in the sense of this patent application and the special, preferred characteristics of active fluids of that kind.

The two receiving containers 1, 2 are either constructed separately and connected together, for example by gluing or detenting or by another connecting element, or—as in the illustrated example of embodiment—constructed integrally with one another. In that respect reference may be made, for the different variants able to be selected here, to the state of the art explained in the introduction. Preference is in fact given to a dispenser bottle in which the two receiving containers 1, 2 are constructed integrally with one another. This is explained in more detail later.

Figure 3:
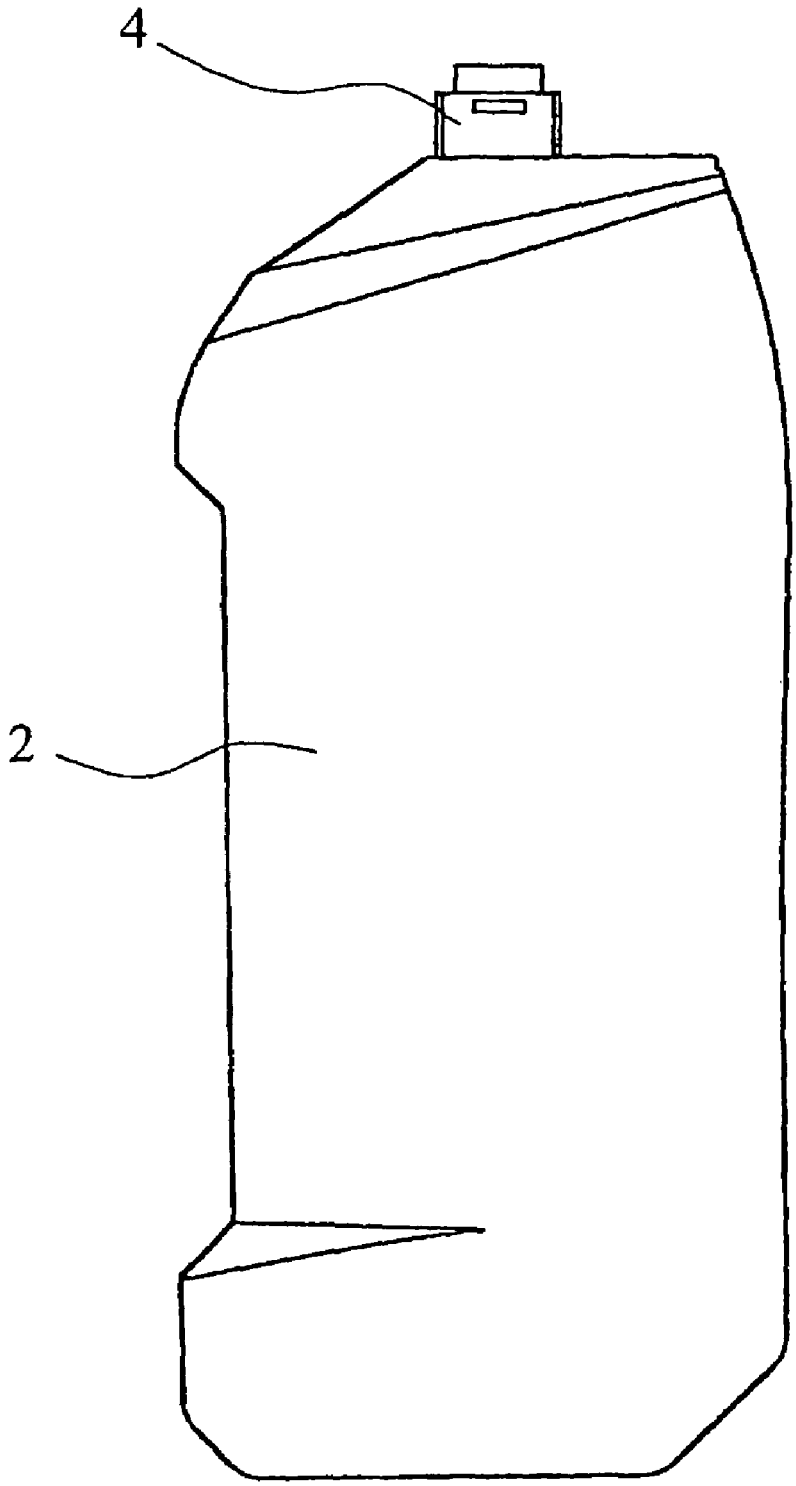
FIG. 3 is a right side elevation of the dispenser bottle of FIG. 1 in an illustration corresponding with FIG. 2, but without metering head and the closure cap.
Figure 4:
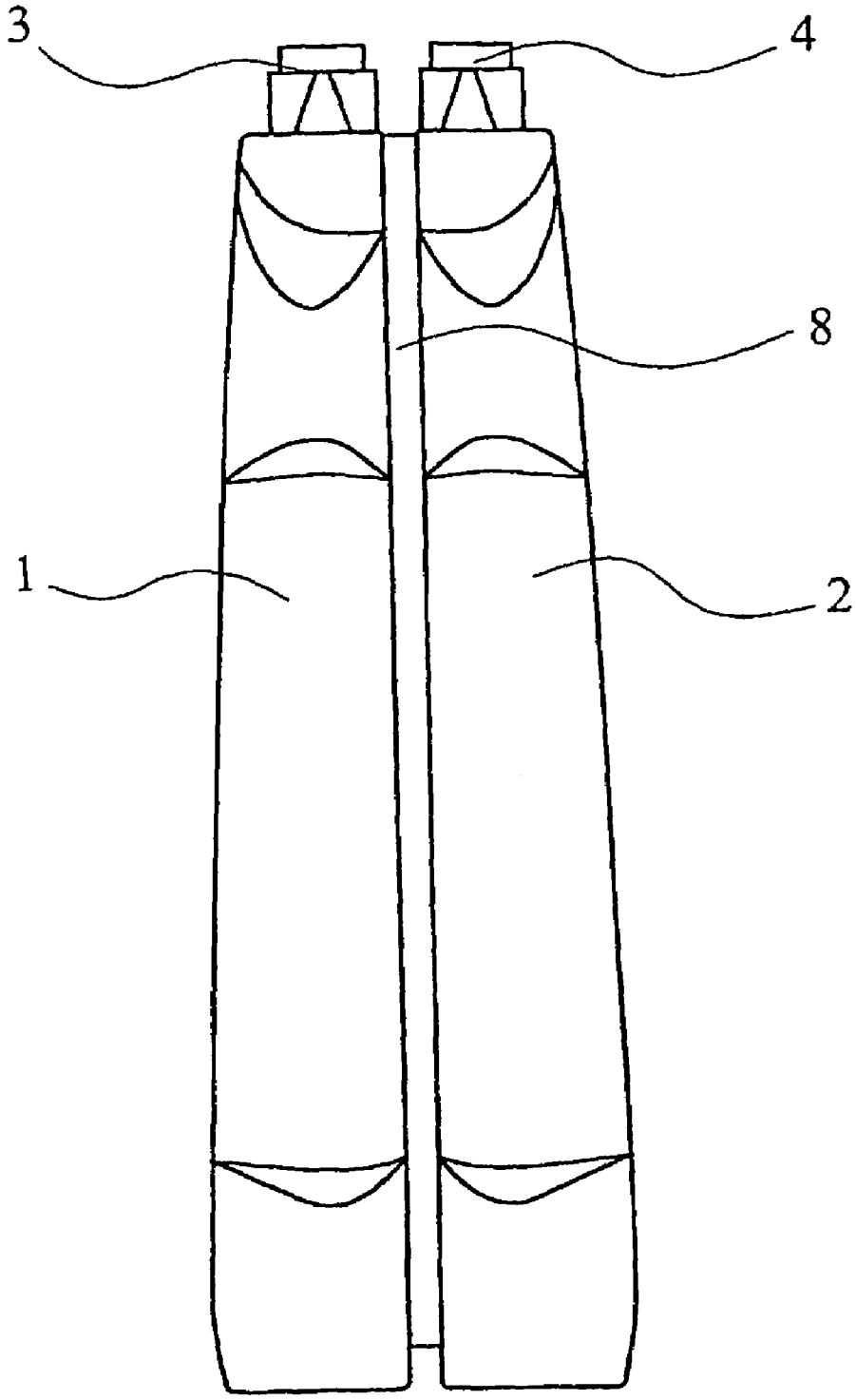
FIG. 4 is a rear elevation of the dispenser bottle of FIG. 3.

FIGS. 3 and 4 show the receiving containers 1, 2 per se. It can be seen that the receiving containers each have an outlet 3 or 4 for the respective active fluid. The outlets 3, 4 are arranged adjacent to one another in such a manner that the two active fluids can be applied in a common application field 5, indicated in FIG. 11, of a larger application region. Express mention has been made in the general part of the description of the special significance of this external mixing of the active fluids from the two receiving containers 1, 2, to which reference may be made.

In the following the dispenser bottle according to the teaching of the state of the art forming the starting point of the present invention is always explained as if there are only two receiving containers 1, 2 or two active fluids. The observation in the introduction that use can also be made of more receiving containers has to be kept in mind, since the explanations are equally applicable to such multi-container dispenser bottles.

Figure 11:
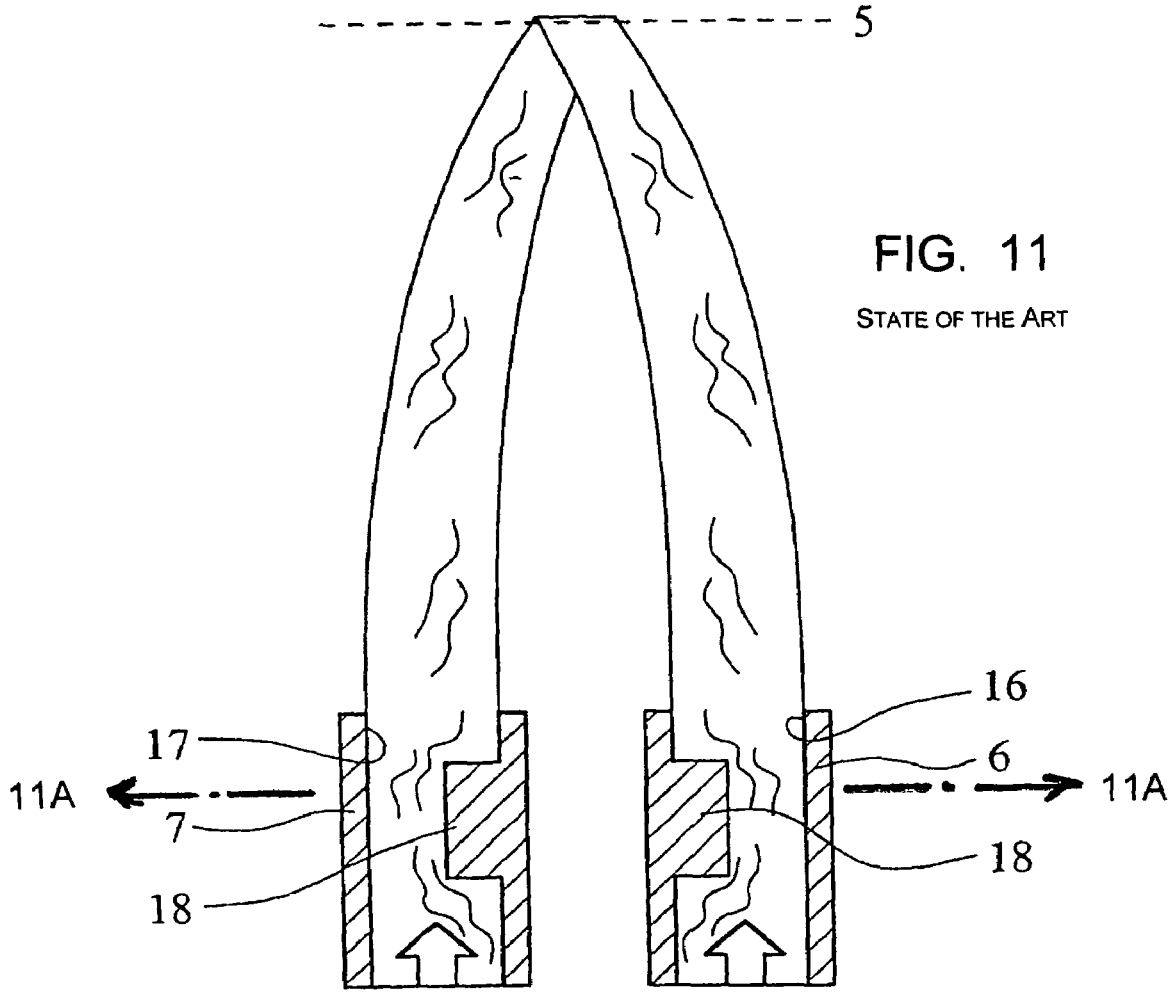
FIG. 11 is a fragmentary side-by-side section showing the jet pattern of the active fluids in the case of an example of embodiment of a dispenser bottle according to the teaching of the state of the art forming the starting point of the present invention.
Figure 11A:
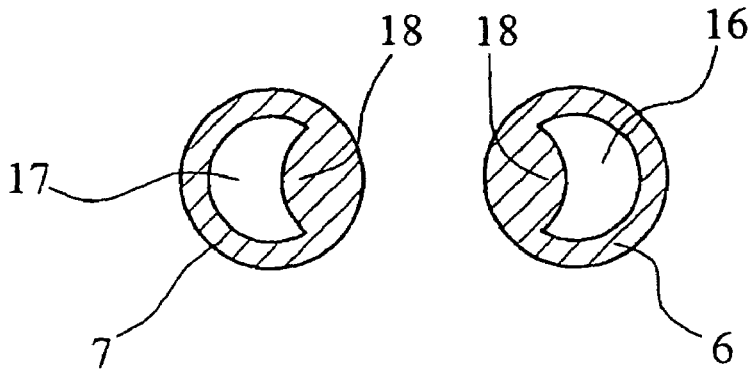
FIG. 11A is a local sectional view taken on the line 11A—11A of FIG. 11.

It is essential first of all that the receiving containers 1, 2 are constructed as compressible containers and that the outlets 3, 4 are each provided with at least one, preferably with exactly one, discharge nozzle 6, 7 so that the active fluids are mixed together only after leaving the discharge nozzles 6, 7. The discharge nozzles 6, 7 can be recognized initially in FIG. 6, additionally also in FIG. 8 and are schematically illustrated in FIG. 11.

Through the claimed design of the dispenser bottle the pressure for expressing the active fluids from the receiving containers 1, 2 is applied by the hand of a user. The active fluids leave the discharge nozzles 6, 7, to which they flow from the outlets 3, 4 of the two receiving containers 1, 2, under pressure. Only after departure from the discharge nozzles 6, 7 does there result, depending on the pressure exerted by the user, collision of the flows of the active fluid at a defined distance and intermixture thereof to form the product to be employed in the application region.

The illustrated example of embodiment additionally shows that the receiving containers 1, 2 consist of a material with a restorative characteristic and/or have a shape assisting restoration to the original form. In particular, it is recommended to produce the receiving containers 1, 2 from a resilient restoring plastics material. Such a material for the receiving containers 1, 2 can be, for example, a polyolefin, particularly a polypropylene (PP), a polyethylene (PE), a polyvinylchloride (PVC) or a polyethylene-terephthalate (PET), particularly a glycol-modified polyethylene-terephthalate (PETG). In that respect reference may again be made to the plastics material spray bottle of EP 0 911 616 B1 already explained in the introduction. Materials of that kind are also suitable for the present case of use.

It is of interest in the case of the previously explained design of the receiving containers 1, 2 that an optimal compressibility can be connected with a uniform return suction effect for the active fluids through the special geometry of the receiving containers 1, 2 in conjunction with the material used. A more uniform and more effective return suction effect for the active fluids from the discharge nozzles 6, 7 back into the receiving containers 1, 2 is of significance for cleaner product detachment at the outer ends of the discharge nozzles 6, 7 at the conclusion of the active fluid dosing.

Overall, use of plastics material containers with appropriate restorative characteristics is economic and yet allows effective dosing of the active fluids in the desired manner, explained further above, without prior mixing.

The example of embodiment, which is illustrated in the drawings, of a dispenser bottle shows for the receiving containers 1, 2 specifically the same volumes and the same shape in mirror image. In principle it would also be possible to provide different volumes if through the shaping, wall thickness and material selection of the receiving containers 1, 2 the desired metering of the active fluids—then differentially—from the receiving containers 1, 2 is obtained. Typical volumes of receiving containers 1, 2 in the domestic field of use lie between 50 millilitres and 1,500 millilitres, wherein a preferred region lies between 300 millilitres and 500 millilitres for each of the receiving containers 1, 2. Obviously that is application-specific and dependent on the active fluids.

Figure 6:
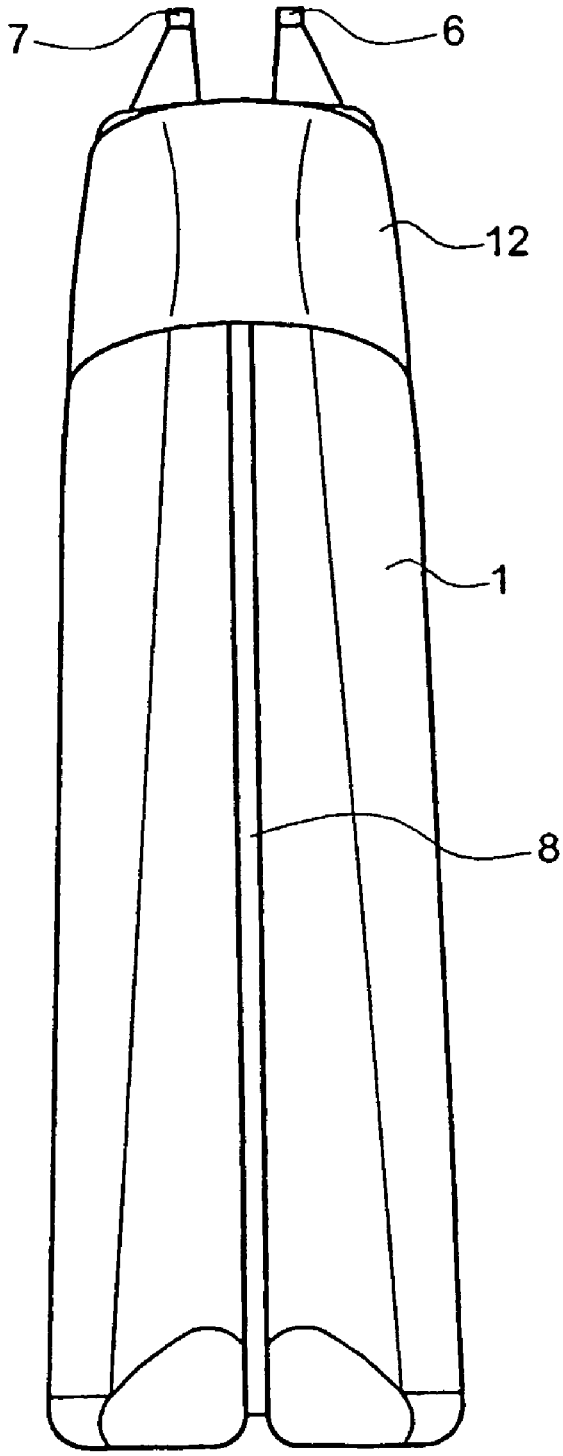
FIG. 6 is a rear elevation of the dispenser bottle of FIG. 5 without the closure cap.
Figure 7:
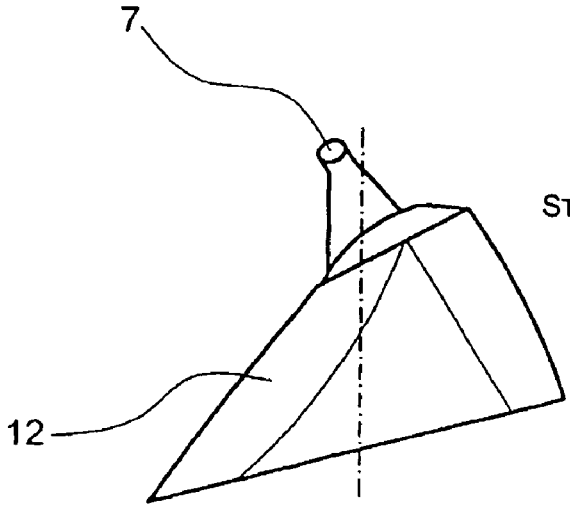
FIG. 7 is an isolated side elevation view of the metering head of a dispenser bottle of FIG. 6.

The illustrated and preferred example of embodiment allows recognition, particularly in FIG. 4, but also in FIG. 6, that the receiving containers 1, 2 are constructed as respectively complete containers and are connected together only by way of at least one, preferably exactly one, connecting web 8 formed between the receiving containers 1, 2. The connecting web 8 is preferably formed integrally at the mutually facing inner sides of the receiving containers 1, 2, particularly, for example, formed simultaneously with the receiving containers 1, 2 by the blow-molding method. It is particularly advantageous if the connecting web 8 is arranged approximately centrally and extends substantially—optionally with interruptions—over the full length of the receiving containers 1, 2. The connecting web 8 thus forms a stiffening element for the mutually facing walls of the receiving containers 1, 2, stabilises these and leads at the same time to formation of a counter-bearing for the pressure forces exerted by the hand of the user. Overall, the receiving containers 1, 2 should conjunctively have such a cross-section that they can at least be embraced for the major part by the hand of a user.

The blow-molding method has already been mentioned beforehand as an advantageous method for production of the receiving containers 1, 2. With corresponding modification, particularly of the blow-molding method, it is possible for the receiving containers 1, 2 formed integrally with one another to have a different light transmissibility and/or a different coloration. In particular, it can be recommended to make, notwithstanding the integral construction, one receiving container opaque and the other receiving container transparent or in the case of more receiving containers to make the receiving containers in different colours. Many active fluids have proved to be light-sensitive. Other active fluids to be applied in conjunction with the respective active fluid are less light-sensitive. An opaque coloration of the receiving container provided for the active fluid which is more light-sensitive eliminates problems in this area.

With respect to handling by a user, the dispenser bottle illustrated in the drawings is further distinguished by the fact that a holding region 9 to be embraced by the hand of a user is formed and/or characterised at the receiving containers 1, 2 by special edge formations 10, 11 and/or surface designs. This can be readily recognized in FIGS. 1 and 2. The grip trough encourages, by shape, gripping of the dispenser bottle by hand from that location. The dispenser bottle has a defined position relative to the hand of the user, which is predetermined by the edge formations 10, 11. Groovings, different colorations, etc., for example, also come into question as surface designs.

With respect to dimensions it has proved expedient not to allow the receiving containers 1, 2 become too large, so as to not hinder ease of handling. Preferred dimensions are such that the receiving containers 1, 2 have in cross-section in the holding region 9 to be gripped by the hand of a user an outer circumference of approximately 18 to approximately 30 centimeters, preferably from approximately 20 to approximately 28 centimeters, particularly from approximately 22 to 26 centimeters, more particularly of approximately 24 centimeters.

Figure 8:
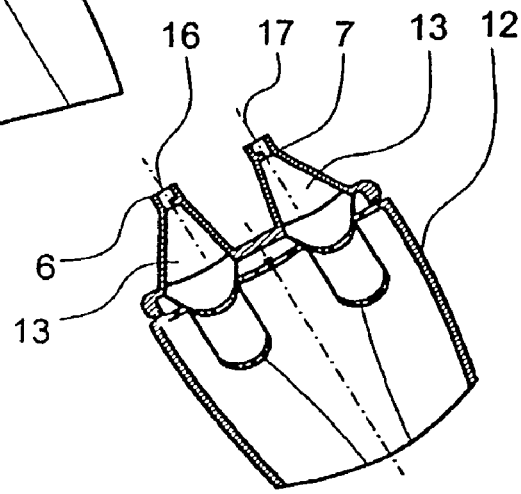
FIG. 8 is a side-by-side section of the metering head of FIG. 7.
Figure 9:
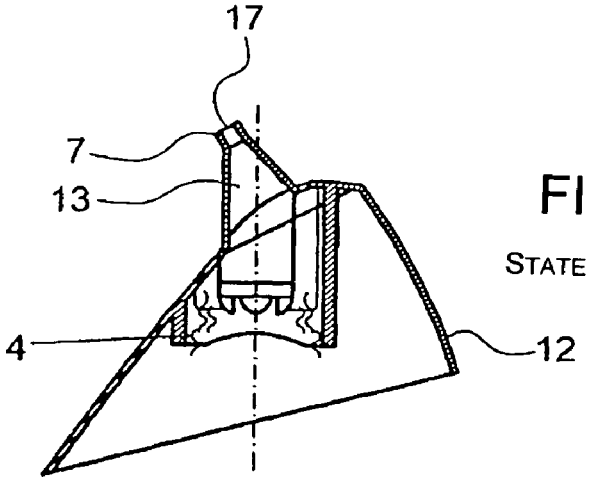
FIG. 9 is a front-to-back section of the metering head of FIG. 7.

What is achieved by the dispenser bottle with the receiving containers 1, 2 has already been mentioned further above. With reference particularly to FIG. 6, FIG. 8 and FIG. 11 it can be explained in this respect that the design and dimensions of the discharge nozzles 6, 7 and the characteristics of the active fluids are so matched to one another that—in the case of average pressure by the hand of a user—the fluid flows coincide at a defined distance. In particular this means that in the case of the illustrated example of embodiment of a dispenser bottle the fluid flows coincide at a distance of approximately 50 millimeters to approximately 300 millimeters, preferably from approximately 100 millimeters to approximately 250 millimeters, particularly of approximately 150 millimeters. That is then approximately the spacing between the discharge nozzles 6, 7 and the application field 5. This corresponds in dimensions with usual distances to be adhered to in domestic cleaning measures.

With respect to viscosity of the active fluids it is recommended to use active fluids with viscosities in the region of 1 to 100,000 mPas, preferably up to approximately 10,000 mPas, particularly up to approximately 1,000 mPas. These particulars are based on viscosity measured by a Brookfield viscometer LVT-II at 20 rpm and 20° C., spindle 3.

Frequent use may be made of aqueous solutions of the kind already mentioned in the general part of the description (see in that respect also U.S. Pat. No. 5,911,909 A and U.S. Pat. No. 5,972,239 A, the disclosure of which is incorporated in the disclosure of the present patent application by reference). Mention has already been made above to the fact that it can be of particular significance for the teaching of the state of the art forming the starting point of the present invention if at least one of the active fluids is a thixotropic active fluid. In particular, however, all active fluids used should be thixotropic, preferably with approximately the same thixotropy. In that respect, for explanation of the complex relationships of thixotropic active fluids reference may be made to the above-indicated documentary reference of RÖMPP.

FIGS. 3 and 4 show the receiving containers 1, 2 with the outlets 3, 4. In this case the outlets 3, 4 are aligned parallel to one another. A pre-alignment of the flows of the active fluids can also be created in that the outlets 3, 4 of the receiving containers 1, 2 are already aligned somewhat at an inclination towards one another. In terms of production, however, the illustrated parallel alignment has advantages.

In principle it is possible, but not with the blow-molding method concretely realized here, to form the discharge nozzles 6; 7 integrally at the outlet 3; 4 at the receiving container 1; 2. However, this variant was not selected in the illustrated example of embodiment. Rather, in the illustrated example of embodiment the discharge nozzles 6 and 7 are arranged or formed in a separate metering head 12 here consisting of a plastics material of stable form and that the metering head 12 is placed at the outlet 3; 4 on the receiving container 1; 2. The metering head 12 is identified in each of the figures by reference numeral 12. In the illustrated example of embodiment the metering head 12 is mounted by detents on the receiving container 1; 2. The metering head 12 can also be connected with the receiving container 1; 2 in a different manner. However, detenting is recommended as a particularly simple and advantageous production technique.

For detenting the metering head 12 on the respective receiving container 1; 2 it is recommended to provide on the outlet 3; 4 of the receiving container 1; 2 appropriate detent connecting means for complementary detent connecting means of the metering head 12. Detent connecting means of that kind with appropriate constructions are known from the state of the art. In principle, other connecting techniques are also usable such as, for example, screw connections.

The illustrated and preferred example of embodiment is particularly distinguished by the fact that the nozzles of the two receiving containers 1; 2 are combined into a common metering head 12. This common metering head 12 can be seen in FIGS. 6, 8, 9 and 10. It is very practical in terms of production engineering and well adapted to the connection of the two receiving containers 1, 2.

It is recommended to produce the metering head 12 from a stiffer plastics material so that the metering head 12 experiences only a slight deformation when the receiving containers 1, 2 of the dispenser bottle are compressed.

Figure 5:
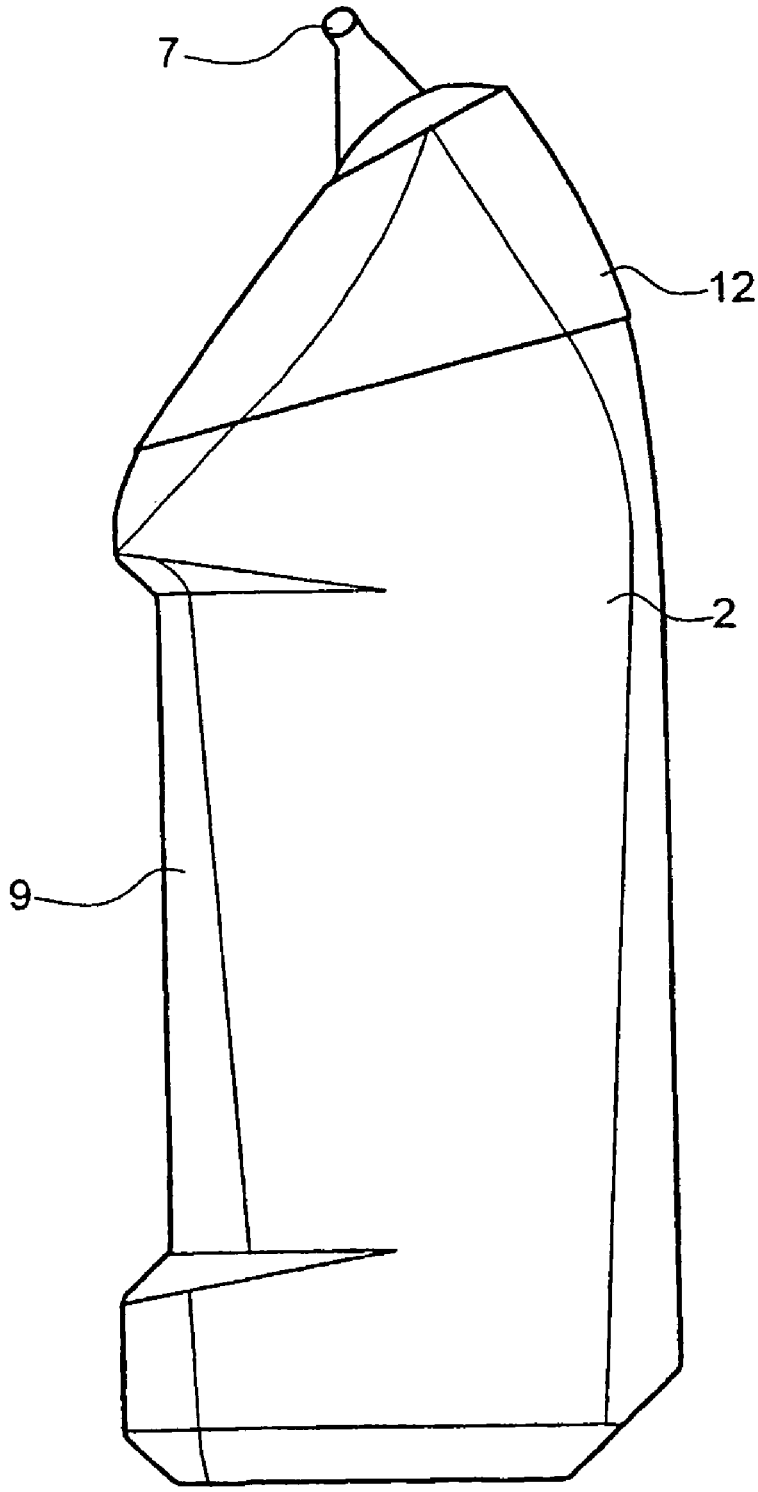
FIG. 5 is a side elevation of the dispenser bottle of FIG. 2, the closure cap for the discharge nozzles being removed.

There is a number of design possibilities for the metering head 12, which shall be explained in the following. The metering head 12 can be recognized in the above-mentioned illustrations as well as in FIG. 5 and FIG. 6. The metering head 12 can be seen particularly well in section in FIGS. 8, 9 and 10. It has proved to be advantageous for the flow of the active fluid in the metering head 12 for the discharge nozzle 6; 7 to be asymmetrically arranged in the metering head 12, in particular offset relative to the center line 16*a*; 17*a* of the nozzle 16;17 of the outlet 3; 4 in the direction of the respective other discharge nozzle 7; 6. This can be seen particularly clearly in FIG. 8. The flow of the active fluid from the respective receiving container 1; 2 is guided to the parallel outflowing active fluid at the desired distance.

A constructional solution ensuring a laminar flow is recognizable here. In particular that the meeting head 12 has converging walls producing an incident flow volume 13 reducing from the outlet 3; 4 of the receiving container 1; 2 towards the discharge nozzles 6; 7. This incident flow volume 13 can be readily comprehended in FIG. 8 and FIG. 9.

The illustrated and preferred example of embodiment shows a dimensioning of such a kind that the lateral center spacing of the discharge nozzles 6; 7 is at the outside approximately 5 millimeters to approximately 30 millimeters, preferably approximately 15 millimeters to approximately 20 millimeters.

Figure 2:
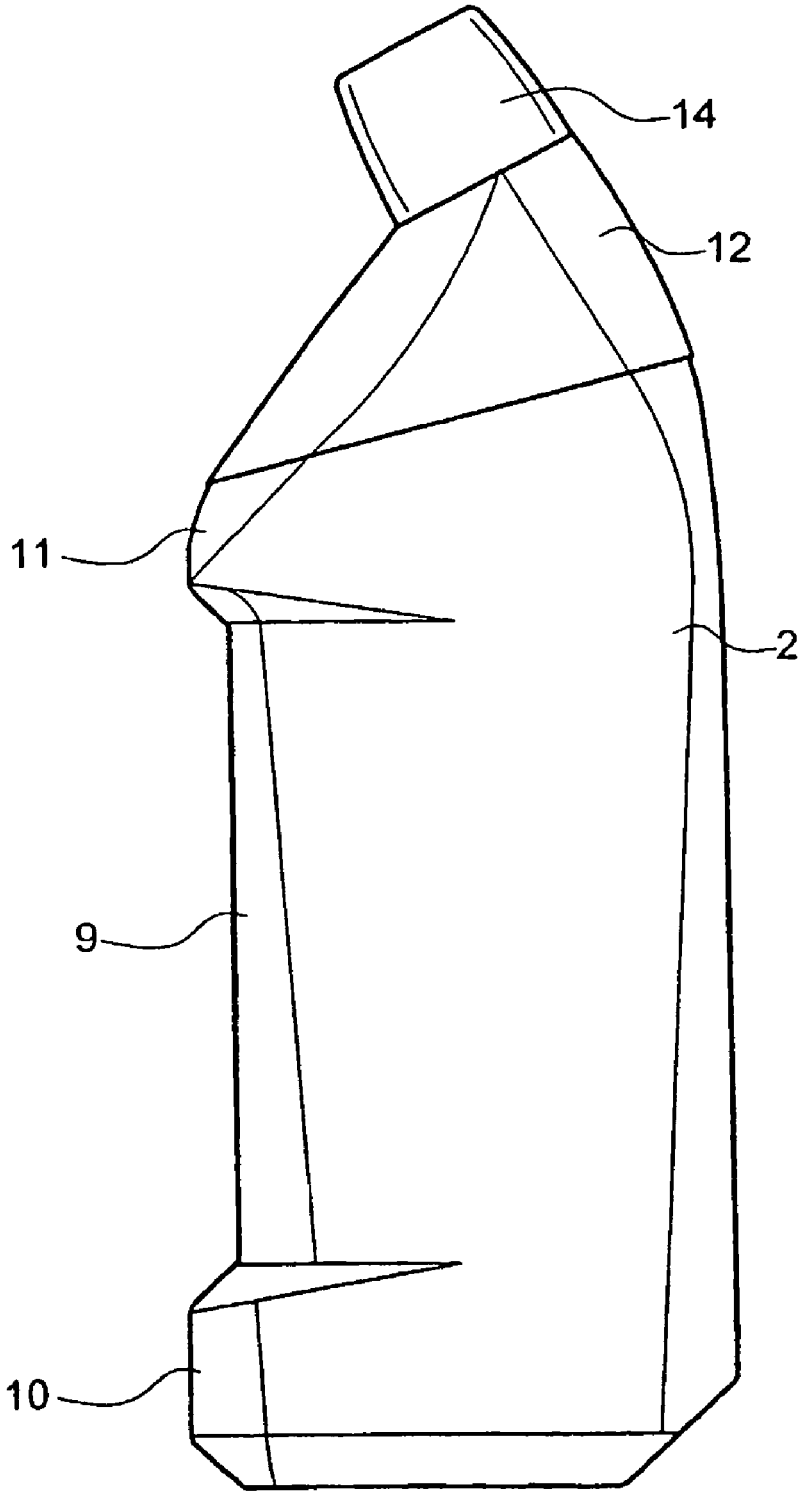
FIG. 2 is a right side elevation of the dispenser bottle of FIG. 1.
Figure 10:
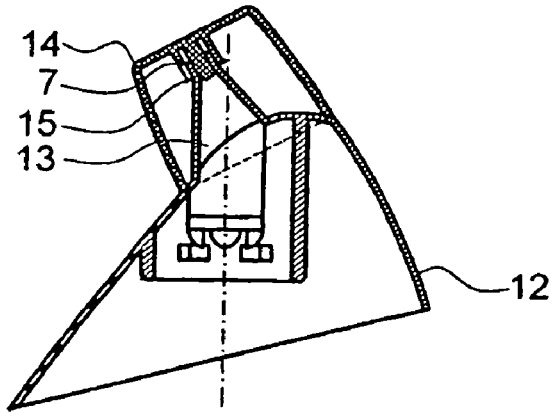
FIG. 10 is a sectional view corresponding to FIG. 9 of the metering head with the closure cap fitted.

It can be seen from FIGS. 1 and 2 as well as from FIG. 10 that also for the dispenser bottle illustrated here the discharge nozzle 6; 7 is closable by a removable closure cap 14, which preferably consists of a plastics material of stable form. In that case the closure cap 14 has a closure plug 15 entering into the discharge nozzle 6; 7. This technique has already proven satisfactory for avoidance of cross contaminations (compare above WO 91/04923 A1).

The illustrated and preferred example of embodiment shows, as readily recognizable in FIG. 1, that for the closure cap 14 as well this can be combined for the two discharge nozzles 6, 7 of the two receiving containers 1, 2. This is advantageous in terms of production, as already explained to be advantageous in the case of the metering head 12. Expediently, the closure cap 14 consists of a plastics material similar to or the same as that of the metering head 12.

It can be inferred from the drawings that the discharge nozzles 6, 7—obviously—have a nozzle channel along the centerline 16*a* or 17*a*. In that case it is possible for the nozzle channels 16, 17 of the discharge nozzles 6, 7 to be inclined towards one another. The exiting flows of the active fluids would then already have an orientation onto a common application field 5 (see FIG. 11). The illustrated and in that respect preferred example of embodiment shows, however, that the nozzle channels 16, 17 of the discharge nozzles 6, 7 are aligned parallel to one another. A slight inclination is obviously acceptable within the scope of, for example, production tolerances.

In particular, in the case of the last-mentioned example of embodiment, which is illustrated in the drawing, with the nozzle channels 16, 17 oriented substantially parallel to one another it is particularly advantageous if the nozzle channels 16; 17 of the discharge nozzles 6; 7 each have a cross-sectional constriction 18 arranged asymmetrically with respect to the overall flow cross-section.

The cross-sectional constriction 18 in the respective nozzle channel 16, 17 has the consequence that a certain degree of swirl is imparted to the flows of the active fluids so that a measure of deflection takes place each time in the outlet region of the discharge nozzles 6, 7 in order that the flows of the active fluids then collide, with intermixing, in the application field 5 at a distance dependent to a certain extent on the pressure of the hand of the user on the receiving containers 1, 2.

A bringing together of the flows of the active fluids not by alignment of the nozzle channels 16, 17, but by influencing the flow is thus achieved. Moreover, a complete coincidence of the flows of the active fluids in the application field is achieved and not just partial coincidence obtained by dispersion action such as could arise with unmodified nozzle channels 16, 17.

The last-mentioned, particularly preferred form of embodiment of the invention requires further explanation.

FIG. 11 shows at the top the functional principle of the cross-sectional constrictions 18 and at the bottom an example of the arrangement of the cross-sectional constrictions 18 according to the teaching of the state of the art, which forms the starting point of the present invention, in the mutually adjacent nozzle channels 16, 17. Here it can be seen at the outset that in the illustrated and, in that respect, preferred example of embodiment the cross-sectional constrictions 18 of the nozzle channels 16, 17 are formed with edged transitions. This has the consequence in terms of flow that different flow speeds arise over the flow cross-section of the nozzle channels 16; 17. At a distance from the cross-sectional constriction 18 the active fluid can flow comparatively undisturbed, a high flow speed with laminar flow being maintained. At the cross-sectional constriction 18 a substantially increased flow speed does indeed occur at the narrowest cross-section, but on departure from the narrow point there is again a strong reduction in flow speed connected with creation of turbulence. This leads overall to the swirl-like behavior of the flows of the active fluids as discussed above.

In addition, it can be seen in FIG. 11 that the cross-sectional constrictions 18 according to the teaching of the state of the art, which forms the starting point of the present invention, at the mutually facing sides of the nozzle channels 16; 17 are arranged in such a manner that the flows, which issue under pressure, of the active fluids have such a twist that they run together.

According to the teaching of the state of the art forming the starting point of the present invention it has proved advantageous for the effect of the cross-sectional constriction 18 if this is present not over the full length of the nozzle channel 16; 17, but is confined to a short piece of this length. It is thus recommended for the length of the cross-sectional constriction 18 of the nozzle channel 16; 17 to amount, in total, to only a part of the length of the nozzle channel 16; 17. It is particularly recommended for the length ratio to be approximately 1:2 to 1:4, preferably approximately 1:2.5 to 1:3.

For the field of use—which is particularly in view here—in the household and the use of thinly viscous, preferably thixotropic active fluids it is recommended for the overall length of the nozzle channel 16; 17 to be approximately 2 millimeters to approximately 6 millimeters, preferably approximately 3 millimeters to approximately 5 millimeters, particularly about 4 millimeters. Correspondingly, the diameter of the nozzle channel 16; 17 is approximately 1.0 millimeters to approximately 4.0 millimeters, preferably approximately 1.5 millimeters to approximately 3.5 millimeters, particularly approximately 2.0 millimeters to approximately 2.5 millimeters.

The state of the art utilized as starting point for the teaching of the present invention and not prior published is also concerned with advantageous combinations and recipes of active fluids able to be applied by such a dispenser bottle according to the teaching of the start of the art forming the starting point of the present invention. In that respect, reference is made particularly to the disclosure of DE 102 38 431 A1 and WO 2004/018319 A1 and the prior-published specifications, cited there additionally, with details of active fluids, etc. Equally, reference is made to the examples of embodiment there, which are also relevant in the same manner within the scope of the present invention and which through reference are hereby incorporated in the application documents of the present application.

Figure 12:
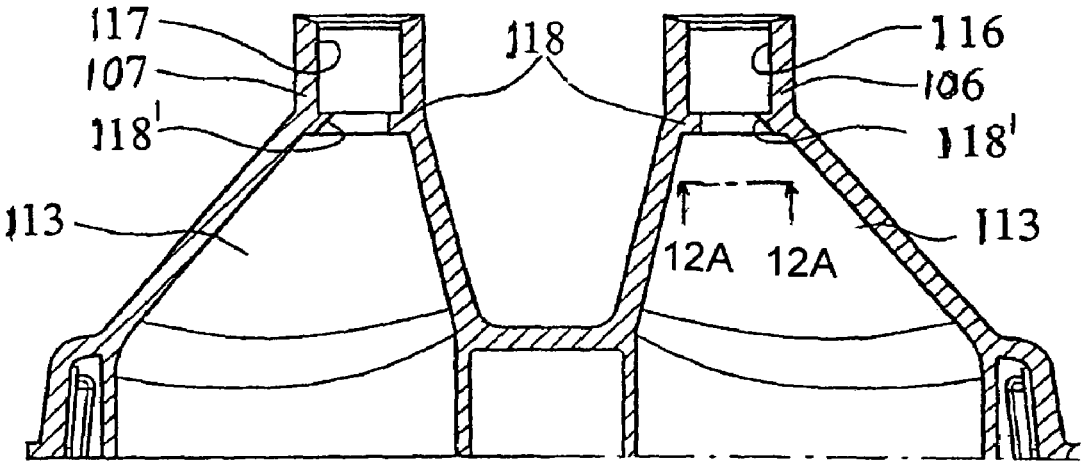
FIG. 12 shows, in an illustration similar to FIG. 11, but in concrete terms somewhat more similarly to FIG. 8, the upper part of an example of embodiment of a dispenser bottle according to the teaching of the invention.
Figure 12A:
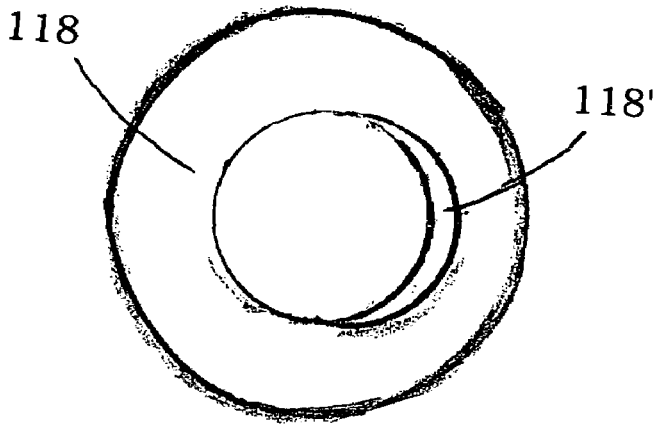
FIG. 12A is a greatly enlarged bottom view of the constriction as seen from the line 12A—12A in FIG. 12.

FIG. 12 shows a section similar to FIG. 11 for the dispenser bottle according to the teaching of the present invention. Here it can be readily seen that the discharge nozzles 106; 107 have nozzle channels 116; 117 and the nozzle channels 116; 117 of the discharge nozzles 106; 107 are oriented substantially parallel to one another, that the nozzle channels 116; 117 of the discharge nozzles 106; 107 each have an annular cross-sectional constriction 118, that the cross-sectional constrictions 118 are arranged to encircle in the nozzle channels 116; 117, that the cross-sectional constrictions 118 are formed at the mutually facing sides of the nozzle channels 116; 117 with edged transitions and that the cross-sectional constrictions 118 at the mutually remote sides of the nozzle channels 116; 117 are oriented, starting from the incident flow side, at an inclination towards the center of the nozzle channels 116; 117, thus are provided at the incident flow side with a bevel 118'. In the illustrated example of embodiment the bevel 118' extends in the respective nozzle channel 116; 117 over approximately half the cross-sectional constriction 118 and here, in particular, precisely symmetrically. In principle the present teaching also applies in corresponding manner if the nozzle channels 116; 117 of the discharge nozzles 106;107 are oriented at an angle towards one another. However, the design is particularly simple in the case of substantially parallel orientation of the nozzle channels 116; 117.

As shown in FIG. 12, the nozzles 106 and 107 have nozzle channels 116 and 117 with converging walls providing reducing flow volumes 113 below the constrictions 118, and straight cylindrical outlets 103 and 104 above the constrictions. In FIG. 12, the constrictions are positioned at the line where the converging walls merge into the straight cylindrical outlets. The outside walls of the volumes 113 below the bevels 118' converge more steeply (in FIG. 12, approximately 40°) than the inside walls below the unbevelled part of the constriction (in FIG. 12, approximately 15°).

According to a preferred embodiment it is provided that the bevels 118' have a bevel angle relative to the center axes of the nozzle channels 116; 117 of 5° to 85°, preferably approximately 10° to 60°, especially 35°. In the illustrated example of embodiment, a bevel angle of the bevel 118' of approximately 40° is present.

Finally, it can be seen that in the illustrated and preferred example of embodiment the annular cross-sectional constrictions 118 are arranged overall, with the exception of the bevels 118', symmetrically with respect to the total flow cross-section of the nozzle channels 116; 117. That is realized here by the cross-sectional constrictions 118 being formed overall, with the exception of the bevels 118', annularly in cylindrical nozzle channels 116; 117.

The co-operation of the differently contoured regions of the cross-sectional constriction 118 in the respective nozzle channel 116; 117 leads to an even more strongly optimized and readily calculable radiation pattern of the fluids.

The invention claimed is:

1. Dispenser bottle with a first receiving container for a first active fluid and at least one second receiving container for a second active fluid, wherein the receiving containers each have an outlet for the active fluid, the outlets being arranged adjacent to one another so that the two active fluids can be applied to a common application field, the receiving containers being compressible, said outlets being provided with at least one discharge nozzle constructed and arranged so that the active fluids are mixed together only after leaving the discharge nozzles, wherein said discharge nozzles having nozzle channels for outward discharge of fluids in an outward direction , each having a cross-sectional constriction extending into said channels generally transversely of said outward direction, said cross-sectional constrictions at the mutually remote sides of the nozzle channels being chamfered in direction from the incident flow side towards the center of the nozzle channels to provided a bevel at the incident flow side of the constriction.

2. Dispenser bottle according to claim 1, wherein said bevels extend symmetrically over approximately half the cross-sectional constriction.

3. Dispenser bottle according to claim 1, wherein said bevels have a bevel angle relative to the center axes of the nozzle channels in the range of 50° to 85°.

4. Dispenser bottle according to claim 1 wherein said bevels have a bevel angle between 35° and 45°.

5. Dispenser bottle according to claim 1, wherein said cross-sectional constrictions encircle the interior of said nozzle channels.

6. Dispenser bottle according to claim 5, wherein said cross-sectional constrictions have edged transitions at mutually facing sides of the nozzle channels.

7. Dispenser bottle according to claim 6, wherein said edged transitions have said bevels, said cross sectional constrictions being arranged, with the exception of said bevels, symmetrically with respect to the overall flow cross-section of the nozzle channels.

8. Dispenser bottle according to claim 5, wherein the cross-sectional constrictions are annular.

9. Dispenser bottle according to claim 1, wherein the nozzle channels have straight cylindrical outlets, and converging walls providing reducing flow channels which merge into said outlets, said constrictions being positioned in said nozzle channels where the converging walls merge into said cylindrical outlets.

10. Dispenser bottle with a first receiving container for a first active fluid and at least one second receiving container for a second active fluid, wherein the receiving containers each have an outlet for the active fluid, the outlets being arranged adjacent to one another so that the two active fluids can be applied to a common application field, the receiving containers being compressible, said outlets being provided with at least one discharge nozzle constructed and arranged so that the active fluids are mixed together only after leaving the discharge nozzles, wherein said discharge nozzles having nozzle channels each having a cross-sectional constriction said cross-sectional constrictions at the mutually remote sides of the nozzle channels being chamfered in direction from the incident flow side towards the center of the nozzle channels to provided a bevel at the incident flow side of the constriction, wherein the nozzle channels have straight cylindrical outlets, and converging walls providing reducing flow channels which merge into said outlets, said constrictions being positioned in said nozzle channels where the converging walls merge into said cylindrical outlets, wherein the remote walls of said converging flow channels converge more steeply than the near walls, whereby each bevel provides a transition between said steeply converging flow channel and said outlet.

11. Dispenser bottle with a first receiving container for a first active fluid and one second receiving container for a second active fluid, wherein the receiving containers each have an outlet for the active fluid, the outlets being arranged adjacent to one another so that the two active fluids can be applied to a common application field, the receiving containers being compressible, said outlets being provided with parallel discharge nozzles constructed and arranged so that the active fluids are mixed together only after leaving the discharge nozzles, wherein said discharge nozzles having nozzle channels for outward discharge of fluids in an outward direction, each having a cross-sectional constriction encircling its respective nozzle channel extending into said channels generally transversely of said outward direction, said cross-sectional constrictions at the mutually remote sides of the nozzle channels being chamfered in direction from the incident flow side towards the center of the nozzle channels to provided a bevel at the incident flow side of the constriction.

* * * * *